US005452543A

United States Patent [19]

VonWald et al.

[11] Patent Number: 5,452,543

[45] Date of Patent: Sep. 26, 1995

[54] WINDOW OPERATOR TRACK WITH INTEGRAL LIMIT STOP

[75] Inventors: David R. VonWald; Perry L. Virkler, both of Owatonna, Minn.

[73] Assignee: Truth Hardware Corporation, Owatonna, Minn.

[21] Appl. No.: 285,403

[22] Filed: Aug. 3, 1994

[51] Int. Cl.[6] ..... E05F 11/24

[52] U.S. Cl. ..... 49/346; 16/95 R

[58] Field of Search ..... 49/346, 339, 252, 49/260, 261, 341, 342, 350, 351; 16/95 R, 96 R, 93 R

[56] References Cited

U.S. PATENT DOCUMENTS

| | | | |
|---|---|---|---|
| Re. 34,230 | 4/1993 | Tucker et al. . | |
| 1,113,334 | 10/1914 | Harbaugh | 49/346 |
| 1,511,010 | 10/1924 | Spencer, Jr. | 49/346 |
| 2,775,446 | 12/1956 | Stavenau et al. . | |
| 2,824,735 | 2/1958 | Stavenau et al. . | |
| 2,977,810 | 4/1961 | Stavenau . | |
| 3,032,330 | 5/1962 | Stavenau . | |
| 3,064,965 | 11/1962 | Stavenau . | |
| 3,064,966 | 11/1962 | Stavenau . | |
| 3,214,157 | 10/1965 | Stavenau . | |
| 3,258,874 | 7/1966 | Martin . | |
| 3,510,984 | 5/1970 | Kalog et al. | 49/346 X |
| 3,728,820 | 4/1973 | Lange | 49/346 |
| 4,241,541 | 12/1980 | Van Klompenburg et al. . | |
| 4,253,276 | 3/1981 | Peterson et al. . | |
| 4,266,371 | 5/1981 | Erdman et al. . | |
| 4,305,228 | 12/1981 | Nelson . | |
| 4,497,135 | 2/1985 | Vetter . | |
| 4,617,758 | 10/1986 | Vetter . | |
| 4,823,508 | 4/1989 | Allen . | |
| 4,840,075 | 6/1989 | Tucker . | |
| 4,843,703 | 7/1989 | Nolte et al. . | |
| 4,845,830 | 7/1989 | Nolte et al. . | |
| 4,864,686 | 9/1989 | Lasier et al. | 16/95 R |
| 4,894,902 | 1/1990 | Tucker . | |
| 4,932,695 | 6/1990 | Pettit et al. . | |
| 4,937,976 | 7/1990 | Tucker et al. . | |
| 4,938,086 | 7/1990 | Nolte et al. . | |
| 4,945,678 | 8/1990 | Berner et al. . | |
| 5,054,239 | 10/1991 | Tucker et al. . | |
| 5,152,103 | 10/1992 | Tucker et al. . | |
| 5,199,216 | 4/1993 | Vetter et al. . | |
| 5,272,837 | 12/1993 | Nolte et al. . | |
| 5,313,737 | 5/1994 | Midas . | |

*Primary Examiner*—Philip C. Kannan

*Attorney, Agent, or Firm*—Wood, Phillips, VanSanten, Clark & Mortimer

[57] ABSTRACT

A track securable to a window sash for guiding the roller of a window operator having an operator arm selectively pivotable relative to a window frame to move the sash relative to said frame, the arm having the roller at its distal end. The track includes two substantially parallel spaced longitudinal walls connected by a longitudinal wall substantially perpendicular to and extending between the parallel walls, an operator roller being receivable between the parallel walls. An integral stop is stamped in the connecting wall, and includes a non-planar portion angled at one end from the connecting wall into the space between the parallel walls, and an arcuate end surface extending in a direction substantially perpendicular to the path of roller travel from the other end of the non-planar portion to substantially adjacent the connecting wall. A second stop is similarly stamped in the connecting wall but facing in the opposite direction of the first stop, whereby the two stops allow for use of the track in either left handed or right handed window sash installation.

13 Claims, 1 Drawing Sheet

WINDOW OPERATOR TRACK WITH INTEGRAL LIMIT STOP

BACKGROUND OF THE INVENTION

1. Technical Field

The present invention is directed toward window operators, and more particularly toward an improved track for use with window operators having a roller controlling movement of the sash.

2. Background Art

Window operators are well known in the art for controlling movement of window sashes relative to their frames. Operators for casement type windows, in which the sash is pivoted open or closed about an axis on one side of the sash are also known. Examples of such operators are shown, for example, in U.S. Pat. No. (Stavenau et al.) 2,775,446, U.S. Pat. No. (Stavenau et al.) 2,824,735, U.S. Pat. No. (Stavenau) 2,977,810, U.S. Pat. No. (Stavenau) 3,032,330, U.S. Pat. No. (Stavenau) 3,064,965, U.S. Pat. No. (Stavenau) 3,064,966, U.S. Pat. No. (Stavenau) 3,214,157, U.S. Pat. No. (Stavenau) 3,258,874, U.S. Pat. No. (Van Klompenburg et al.) 4,241,541, U.S. Pat. No. (Peterson et al.) 4,253,276, U.S. Pat. No. (Erdman et al.) 4,266,371, U.S. Pat. No. (Nelson) 4,305,228, U.S. Pat. No. (Vetter) 4,497,135, U.S. Pat. No. (Vetter) 4,617,758, U.S. Pat. No. (Allen) 4,823,508, U.S. Pat. No. (Tucker) 4,840,075, U.S. Pat. No. (Nolte et al.) 4,843,703, U.S. Pat. No. (Nolte et al.) 4,845,830, U.S. Pat. No. (Tucker) 4,894,902, U.S. Pat. No. (Tucker et al) 4,937,976, U.S. Pat. No. (Nolte et al.) 4,938,086, U.S. Pat. No. (Berner et al.) 4,945,678, U.S. Pat. No. (Tucker et al.) 5,054,239, U.S. Pat. No. (Tucker et al.) 5,152,103, U.S. Pat. No. (Vetter et al.) 5,199,216, U.S. Pat. No. (Tucker et al.) Re. 34,230, U.S. Pat. No. (Nolte et al.) 5,272,837, and U.S. Pat. No. (Midas) 5,313,737.

With certain of the window operators disclosed in the above patents, such as U.S. Pat. No. (Peterson et al.) 4,253,276, U.S. Pat. No. (Erdman et al.) 4,266,371, U.S. Pat. No. (Tucker) 4,840,075, U.S. Pat. No. (Vetter et al.) 5,199,216, and U.S. Pat. No. (Midas) 5,313,737 (commonly referred to as single arm or double arm operators), movement of the window sash is controlled through an arm having a roller on its end which travels in a track secured to the sash, whereby pivoting of the arm results in the roller acting on the track to correspondingly move the sash. Of course, it will be appreciated that smooth operation of such window operators requires smooth operation of the rollers. However, such smooth operation can be difficult to achieve, particularly over the long expected life of such operators, due to the great stresses which the rollers inevitably face, not only when opening and closing the sash but also when holding the controlled sash in a particular position notwithstanding constantly changing loads (due to changing winds).

In many installations, particularly in areas subject to high winds, it is desirable to include stops to protect against window sash damage which could result from an open window being caught by a gust of wind and violently thrown further open beyond the limits of the sash supporting structure. For example, some hinges are provided with stops which limit the amount which they can be opened. U.S. Pat. No. (Pettit et al.) 4,932,695 shows a support arm with a passive lock system adapted to prevent wind damage and used in conjunction with a hinge. Limit devices completely separate from the operators and hinges have also been used to guard against such damage. Unfortunately, such devices can introduce a relatively high additional cost for the hardware on the window, can involve additional time and therefore added expense in assembling the windows, and in some cases require additional space in the assembled window (which is completely contrary to the desire to minimize the intrusion of hardware on the window opening).

The present invention is directed toward overcoming one or more of the problems set forth above.

SUMMARY OF THE INVENTION

In one aspect of the present invention, a track securable to a window sash is provided for the roller of a window operator having an operator arm selectively pivotable relative to a window frame to move the sash relative to said frame, the arm having the roller at its distal end. The track includes two substantially parallel spaced longitudinal walls connected by a longitudinal wall substantially perpendicular to and extending between the parallel walls, an operator roller being receivable between the parallel walls. An integral stop is stamped in the connecting wall, and includes a non-planar portion angled at one end from the connecting wall into the space between the parallel walls, and an end surface extending substantially from the other end of the non-planar portion to substantially adjacent the connecting wall, where the end surface abuts a roller to limit motion of such roller in the track.

In another aspect of the present invention, the end surface of the stop is arcuate and substantially perpendicular to the path of roller travel.

In yet another aspect of the present invention, a second stop is similarly stamped in the connecting wall but facing in the opposite direction of the first stop, whereby one roller engaging end portion is concave toward a roller limited by the first stop in a left handed window sash installation and the second roller engaging end portion is concave toward a roller limited by the second stop in a right handed window sash installation.

It is an object of the invention to minimize the cost of making, assembling, and maintaining a casement window controlled with a single or double arm window operator or the like moving a sash through moving contact of a roller with the sash.

It is another object of the present invention to accomplish the above without increasing the inventory of parts required to be maintained for the proper construction of such windows.

It is still another object of the present invention to protect such windows from damage due to varying wind loads on the sash.

It is yet another object of the present invention to ensure that such window operators provide smooth and reliable service over their expected long life.

Still another object of the present invention is to accomplish the above without intruding into the visual aesthetics provided by the window opening.

DESCRIPTION OF THE PREFERRED EMBODIMENT

Figure 1:
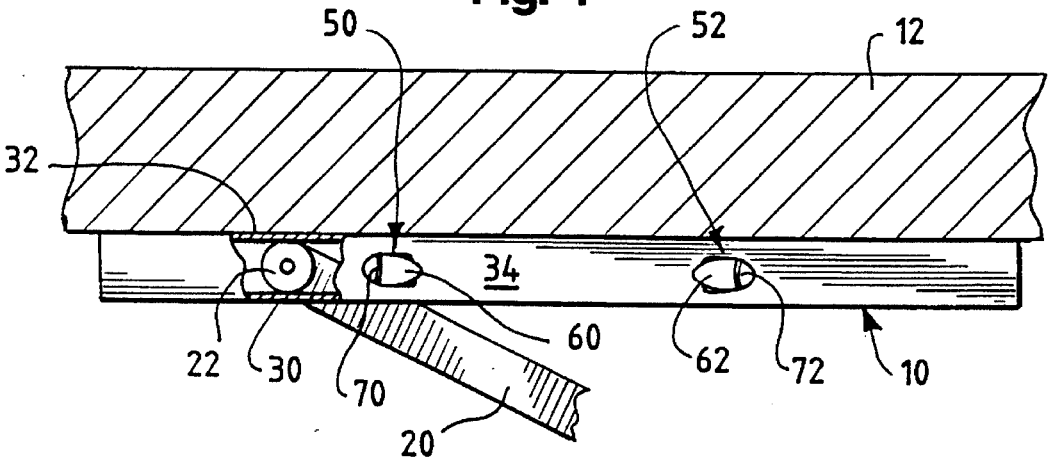
FIG. 1 is a plan view of a partially broken away track embodying the present invention as mounted to a window sash.

An improved track 10 embodying the present invention is illustrated in the Figures. FIG. 1 in particular shows the track 10 as positioned on the interior side of a window sash 12. It will be appreciated that a track embodying the present invention could also be otherwise mounted to a sash, such as in a groove along the bottom of the sash.

An operator arm 20 is partially shown in FIG. 1, and includes a roller 22 rotatably secured on its end and received in the track 10. The operator arm 20 is suitably connected to a drive (not shown) which pivots the arm 20 about its other end so that, through the connection of the roller 22 with the track 10, the track 10 and sash 12 will be pushed outwardly (up in FIG. 1) or pulled inwardly (down in FIG. 1 ). Positioning of the sash 12 will thus, in combination with other suitable linkages and/or hinges, be controlled.

Figure 4:
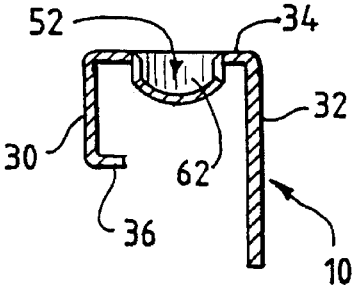
FIG. 4 is a cross sectional view taken along line 4—4 of FIG. 2.
Figure 3:
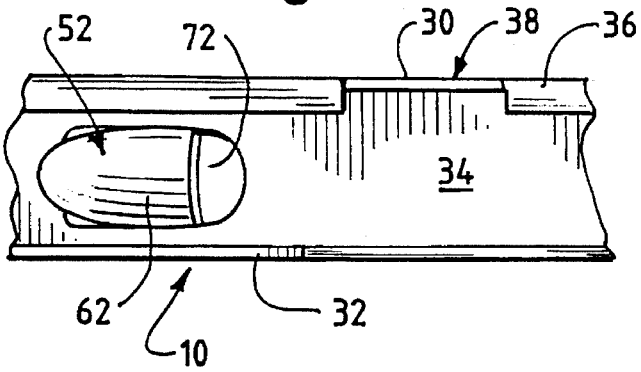
FIG. 3 is an enlarged bottom view of a portion of the track.

As perhaps best illustrated by FIG. 4, the track 10 includes a pair of parallel longitudinal walls 30, 32 connected by a transverse wall 34. Preferably, the spacing between the parallel walls 30, 32 should be slightly greater than the diameter of the roller 22 so that the roller 22 will roll against one of the walls 30 in one direction of operation without rubbing against the other wall 32, and will roll against the other wall 32 in the other direction of operation without rubbing against the one wall 30. A lip 36 is also preferably provided along the bottom of one of the parallel walls 30 to help to keep the roller 22 in the track 10 between the parallel walls 30, 32. Cutouts 38 (see FIG. 3) can also be provided along the lip 36 to ease assembly (or disassembly during maintenance) of the roller 38 in the track 10.

Figure 2:
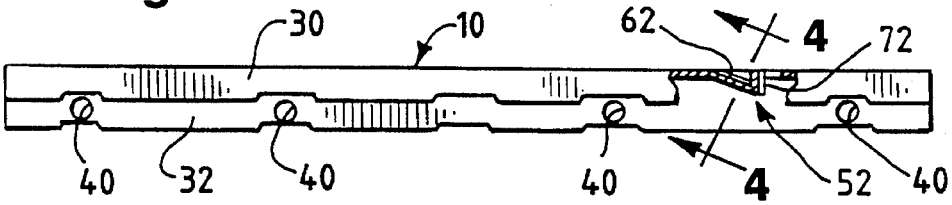
FIG. 2 is a side view, partially broken away, of the track of FIG. 1.

Connector holes 40 (see FIG. 2) are provided along the length of one of the track parallel walls 32, preferably at a location offset laterally (down in the FIG. 4 orientation) from the track walls 30, 32 between which the roller 22 moves. Suitable connectors, such as screws, can be extended through the holes 40 and into the sash 12 to securely mount the track 10 and sash 12 together. The offset positioning of the holes 40 will ensure that the connectors (such as screw heads) will not interfere with smooth travel of the roller 22 in the track 10. Therefore, it should be appreciated that though the roller 22 will only move along less than half of the length of the track 10 in any installation, the entire length of the track 10 will be secured to the sash 12 to provide an extremely secure mounting even under strong wind loads.

The track 10 illustrated in the Figures provides a pair of oppositely facing stops 50, 52. As a result, the track 10 can be used with either left or right handed window installations. For example, as shown in FIG. 1, the window sash 12 will generally pivot about its right side (although, as will be understood by those skilled in the art, the motion of the sash 12 is typically not simple pivotal motion about a fixed axis). In an installation in which the sash 12 is to generally pivot about its left side, the arm would be oriented in the other direction to that shown with the roller in the right end of the track 10. Such ability to use the track 10 for either type of installation as described further below allows window manufacturers to minimize inventory, and further will save time and expense associated with window hardware installation by ensuring that installers not wrongly install a wrong handed track on the sash 12.

Each stop 50, 52 is formed by first stamping the transverse wall 34 to form a non-planar flange so as to include a longitudinally concave portion 60, 62 angled at one end from the transverse wall 34 into the path of roller travel, and then the flange is stamped a second time in the opposite direction to form an arcuate roller engaging end portion 70, 72 bent from the concave portion 60, 62 to an orientation substantially perpendicular to the path of roller travel. Such stops 50, 52 can be easily and inexpensively stamped in the track 10 in an infinite number of positions depending upon the desired allowable range of motion of the window sash 12.

The concave portion 60, 62 provides a strong support for the roller engaging end portions 70, 72, as such orientation effectively ensures that the portion 60, 62 support the end portions 70, 72 not only with the compressive strength of the material (preferably steel) but also with the increased bending strength resulting from the non-planar configuration.

It should also be understood that whichever stop is used in a particular installation (e.g., stop 50 in FIG. 1) will provide ideal operation. The perpendicular orientation of the end portion 70, 72 ensures that the roller 22 will be engaged along its full axial height. Therefore, the stop 50 or 52 will spread out the stress of its contact with the roller 22, to thereby reduce the risk of damage to the roller 22 which could otherwise arise from such stress concentrations. It should be appreciated that such stresses can be very high should a strong gust of wind catch an open sash 12 and jerk it open a distance until the roller 22 contacts the stop 50 or 52. Thus, not only is the risk of failure of the roller 22 minimized, but the risk of cutting the surface of the roller 22 is also minimized. Thus, smooth operation of the window operator over many years is assisted by helping to ensure that the roller surface maintains its desired configuration. A cut roller could, of course, result in binding of the roller in the track and therefore uneven operation when opening and closing a window sash.

Still further, it should be understood that the arcuate orientation of the end portions 70, 72 helps to ensure that the engagement of the roller 22 with the stop 50 or 52 will be with the center of the stop, thereby ensuring that the full concave portion 60, 62 will absorb the force of such contact. Such arcuate configuration will also assist in ensuring that the forces applied to the roller 22 are radially directed through its axial connection to the arm 20 to thereby also minimize roller wear and tear which could detract from smooth future opening and closing operations. Still further, to some degree such arcuate configuration could cushion the shock of contact during high winds by causing a slight rocking action at initial contact of the roller 22 with the stop 50 or 52 (if the roller 22 is not initially centered precisely between the parallel walls 30, 32) rather than a completely abrupt dead stop.

Of course, it should be understood that a track including only one stop such as described above would also provide many of the advantageous features of the present invention, though opposite handed installations would require differently configured tracks.

It should now be appreciated that the track 10 will allow window for minimum cost of making, assembling, and maintaining a casement window controlled with a single or double arm window operator or the like moving a sash through moving contact of a roller with the sash. Tracks having dual stops 50, 52 will also minimize the inventory of parts required to be maintained for the proper construction of such windows, as well as eliminating the chance of installing tracks unsuitable for a particular installation.

Such tracks 10 will reliably protect window sashes from damage due to varying wind loads on the sash, while at the same time ensuring that such window operators provide smooth and reliable service over their expected long life. Still further, these advantages are all accomplished without any expensive additional window hardware components and without intruding into the visual aesthetics provided by the window opening.

Still other aspects, objects, and advantages of the present invention can be obtained from a study of the specification, the drawings, and the appended claims.

We claim:

1. In combination with a window operator having an operator arm selectively pivotable relative to a window frame to move a sash relative to said frame, said arm having a roller at its distal end, an improved track for an operator roller comprising:

two substantially parallel spaced longitudinal walls connected by a longitudinal wall substantially perpendicular to and extending between said parallel walls, an operator roller being receivable between said parallel walls;

means for securing at least one of said track walls to a window sash; and an integral stop stamped in said connecting wall, said stop including a non-planar portion angled at one end from said connecting wall into the space between the parallel walls, and an end surface extending substantially from the other end of the non-planar portion to substantially adjacent the connecting wall, said end surface abutting a roller to limit motion of such roller in the track.

2. The improved track of claim 1, wherein said end surface is arcuate.

3. The improved track of claim 1, wherein said non-planar portion is concave in a longitudinal direction relative to the connecting wall.

4. The improved track of claim 1, wherein said track is steel.

5. A track securable to a window sash and adapted to receive a window operator roller therein whereby the roller travels in said track when said operator moves the secured window sash, comprising:

a substantially U-shaped longitudinal track section with two side walls connected by a transverse wall to define a path for a roller, said side walls being spaced apart a distance slightly greater than the diameter of an operator roller received therebetween whereby such roller rolls on no more than one side wall at any time during operation; and a stop formed of a flange stamped in the transverse wall, said formed flange including a longitudinally concave portion angled at one end from the transverse wall into the path of roller travel in said track section and a roller engaging end portion bent from the concave portion to an orientation substantially perpendicular to the path of roller travel.

6. The track of claim 5, wherein said end portion is arcuate.

7. The track of claim 5, wherein said track is steel.

8. The track of claim 5, wherein said track has a selected length between opposite ends and said stop faces the track end nearest to it for limiting travel of a roller in a window sash installation of one hand, and further comprising a second stop formed of a second flange stamped in the transverse wall, said second formed flange including a second longitudinally concave portion angled at one end from the transverse wall into the path of roller travel in an opposite handed installation of said track section and a second roller engaging end portion bent from the second concave portion to an orientation substantially perpendicular to the path of roller travel in an opposite handed sash installation, said second stop facing the track end nearest to it.

9. A track securable to a window sash and adapted to receive a window operator roller therein whereby the roller travels in said track when said operator moves the secured window sash, comprising:

a substantially U-shaped longitudinal track section with two side walls connected by a transverse wall;

means for securing the track section along its length to a window sash;

a first stop formed of a first flange stamped in the transverse wall, said formed first flange including a first longitudinally concave portion angled at one end from the transverse wall toward an area between the side walls and a first roller engaging end portion bent from the first concave portion to an orientation substantially perpendicular to the longitudinal direction of the track section;

a second stop formed of a second flange stamped in the transverse wall, said formed second flange including a second longitudinally concave portion angled at one end from the tansverse wall toward the area between the side walls and a second roller engaging end portion bent from the second concave portion to an orientation substantially perpendicular to the longitudinal direction of the track section; and said first and second flanges roller engaging end portions facing opposite ends of the track section with the concave portion angled ends disposed between said roller engaging end portions whereby said first and second stops are adapted for use with oppositely handed window sash installations.

10. The track of claim 9, wherein said first roller engaging end portion is concave toward a roller limited by said first stop in a left handed window sash installation and said second roller engaging end portion is concave toward a roller limited by said second stop in a right handed window sash installation.

11. The track of claim 10, wherein said roller engaging end portions are concave about substantially vertical axes.

12. The track of claim 9, wherein said track is steel.

13. The track of claim 9, wherein said first and second stops are centrally located between said track section side walls.

* * * * *